United States Patent [19]

Shoji et al.

[11] Patent Number: 4,724,196

[45] Date of Patent: Feb. 9, 1988

[54] SILVER HALIDE PHOTOGRAPHIC LITH MATERIAL

[76] Inventors: Tadao Shoji, 3-13-6, Ohizumi-machi, Nerima-ku, Tokyo; Yonosuke Tsuka, 264-4, Noda, Omigawa-cho, Katori-gun, Chiba-ken; Naoki Obi, 1-11-29, Matsubara, Setagaya-ku, Tokyo; Yasuhiko Kojima, 1-12-20, Hon-cho, Asaka-shi, Saitama-ken; Yasuo Shigemitsu, 3-29-18, Daito, Urawa-shi, Saitama-ken, all of Japan

[21] Appl. No.: 21,555

[22] Filed: Mar. 2, 1987

Related U.S. Application Data

[63] Continuation of Ser. No. 722,208, Apr. 11, 1985, abandoned.

[30] Foreign Application Priority Data

Apr. 12, 1984 [JP] Japan ..... 59-73635

[51] Int. Cl.[4] ..... G03C 1/72

[52] U.S. Cl. ..... 430/264; 430/265; 430/266; 430/267; 430/949

[58] Field of Search ..... 430/264, 265, 266, 267, 430/600, 611, 949

[56] References Cited

U.S. PATENT DOCUMENTS

| | | | |
|---|---|---|---|
| 3,895,948 | 7/1975 | Shiba et al. | 430/264 |
| 3,901,709 | 8/1975 | Ebato et al. | 430/264 |
| 3,984,243 | 10/1976 | Shimamura et al. | 430/485 |
| 4,169,733 | 10/1979 | Iytaka et al. | 430/949 |
| 4,269,929 | 5/1981 | Nothnagle | 430/264 |
| 4,292,341 | 9/1981 | Overman | 430/267 |

OTHER PUBLICATIONS

Simson, Joseph M., "High Contrast Through the Use of Nucleators", SPSE Paper Summaries, 25th Fall Symposium.

*Primary Examiner*—Won H. Louie
*Attorney, Agent, or Firm*—Sherman & Shalloway

[57] ABSTRACT

A lith-type silver halide photographic material comprising a tetrahydro-1,3,5-triazine-2-thione derivative and a polyalkylene oxide derivative.

7 Claims, No Drawings

SILVER HALIDE PHOTOGRAPHIC LITH MATERIAL

This application is a continuation of application Ser. No. 722,208 filed Apr. 11, 1985, now abandoned.

This invention relates to a silver halide photographic material, and more specifically, to a lith-type silver halide photographic material which gives an image of high contrast, high speed and good dot quality.

Lith-type silver halide photographic art materials are generally processed in a special developer, called a lith developer, containing hydroquinone as a developing agent and having a very low concentration of a free sulfite ion to produce high contrast and good image sharpness.

Such lith characteristics can be obtained by the addition of polyalkylene oxide derivatives to photographic materials. However, the use of polyalkylene oxide derivatives is not practically feasible because they restrain developability during the early stage of development and bring about a marked decrease in sensitivity and an increase in the optimum development time.

Attempts have previously been made to remedy this defect by using quaternary amine compounds or mercaptoimidazole compounds as development accelerators (compounds which do not cause a reduction in sensitivity attributed to the addition of polyalkylene oxide derivatives, increase sensitivity and accelerate development) in combination with the polyalkylene oxide derivatives.

It is an object of this invention therefore to provide a lith-type silver halide photographic material having good lith developability, high contrast and good dot quality by using a new development accelerator which eliminates the aforesaid defect without an increase in fog or a deterioration in granularity.

We have found that this object is achieved by a lith-type silver halide photographic material comprising a tetrahydro-1,3,5-triazine-2-thione derivative and a polyalkylene oxide derivative.

Derivatives represented by the following general formulae (1) and (2) are examples of the tetrahydro-1,3,5-triazine-2-thione derivatives used in this invention.

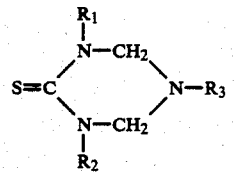

(1)

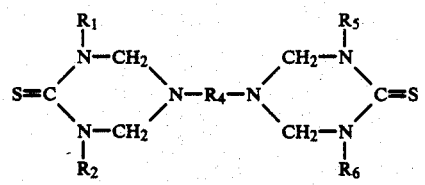

(2)

In formulae (1) and (2), $R_1$, $R_2$, $R_5$ and $R_6$, independently from each other, represent a hydrogen atom or an alkyl or aryl group, $R_3$ represents a substituted or unsubstituted monovalent organic group, and $R_4$ represents a substituted or unsubstituted divalent organic group.

Examples of suitable tetrahydro-1,3,5-triazine-2-thione derivatives include (1) 5-methyl-1,4,5,6-tetrahydro-1,3,5-triazine-2(1H)-thione,
(2) 5-ethyl-1,4,5,6-tetrahydro-1,3,5-triazine-2(1H)-thione,
(3) 5-propyl-1,4,5,6-tetrahydro-1,3,5-triazine-2(1H)-thione,
(4) 5-butyl-1,4,5,6-tetrahydro-1,3,5-triazine-2(1H)-thione,
(5) 5-cyclohexyl-1,4,5,6-tetrahydro-1,3,5-triazine-2(1H)-thione,
(6) 5-cyclopentyl-1,4,5,6-tetrahydro-1,3,5-triazine-2(1H)-thione,
(7) 5-(2-hydroxyethyl)-1,4,5,6-tetrahydro-1,3,5-triazine-2(1H)-thione,
(8) 5-(2-hydroxypropyl)-1,4,5,6-tetrahydro-1,3,5-triazine-2(1H)-thione,
(9) 5-(3-hydroxypropyl)-1,4,5,6-tetrahydro-1,3,5-triazine-2(1H)-thione,
(10) 5-(2-dimethylaminoethyl)-1,4,5,6-tetrahydro-1,3,5-triazine-2(1H)-thione,
(11) 5-(2-hydroxybutyl)-1,4,5,6-tetrahydro-1,3,5-triazine-2(1H)-thione,
(12) 5-(2-diethylaminoethyl)-1,4,5,6-tetrahydro-1,3,5-triazine-2(1H)-thione,
(13) 5-(6-aminohexyl)-1,4,5,6-tetrahydro-1,3,5-triazine-2(1H)-thione,
(14) 5-methoxycarbonylmethyl-1,4,5,6-tetrahydro-1,3,5-triazine-2(1H)-thione,
(15) 5-phenyl-1,4,5,6-tetrahydro-1,3,5-triazine-2(1H)-thione,
(16) 5-phenylmethyl-1,4,5,6-tetrahydro-1,3,5-triazine-2(1H)-thione,
(17) 5-(4-bromophenylmethyl)-1,4,5,6-tetrahydro-1,3,5-triazine-2(1H)-thione,
(18) 5-[4-(2-hydroxyethyl)phenyl]-1,4,5,6-tetrahydro-1,3,5-triazine-2(1H)-thione,
(19) 5-[4-(2-dimethylaminoethyl)phenyl]-1,4,5,6-tetrahydro-1,3,5-triazine-2(1H)-thione,
(20) 5-(2-hydroxy-3-methoxycarbonylpropyl)-1,4,5,6-tetrahydro-1,3,5-triazine-2(1H)-thione,
(21) 5-(4-pyridyl)-1,4,5,6-tetrahydro-1,3,5-triazine-2(1H)-thione,
(22) 1-methyl-5-ethyl-1,4,5,6-tetrahydro-1,3,5-triazine-2(1H)-thione,
(23) 1-methyl-5-(2-hydroxypropyl)-1,4,5,6-tetrahydro-1,3,5-triazine-2(1H)-thione,
(24) 1-methyl-5-[4-(2-hydroxyethyl)phenyl]-1,4,5,6-tetrahydro-1,3,5-triazine-2(1H)-thione,
(25) 1-phenyl-5-methyl-1,4,5,6-tetrahydro-1,3,5-triazine-2(1H)-thione,
(26) 1-phenyl-5-(2-hydroxybutyl)-1,4,5,6-tetrahydro-1,3,5-triazine-2(1H)-thione,
(27) 1-phenyl-5-(4-bromophenylmethyl)-1,4,5,6-tetrahydro-1,3,5-triazine-2(1H)-thione,
(28) 1,3-dimethyl-5-(2-hydroxypropyl)-1,4,5,6-tetrahydro-1,3,5-triazine-2(1H)-thione,
(29) 1,3-dibutyl-5-cyclohexyl-1,4,5,6-tetrahydro-1,3,5-triazine-2(1H)-thione,
(30) 1,3-diphenyl-5-phenylmethyl-1,4,5,6-tetrahydro-1,3,5-triazine-2(H)-thione,
(31) 5,5'-ethylenebis[1,4,5,6-tetrahydro-1,3,5-triazine-2(1H)-thione],
(32) 5,5'-trimethylenebis[1,4,5,6-tetrahydro-1,3,5-triazine-2(1H)-thione],
(33) 5,5'-octamethylenebis[1,4,5,6-tetrahydro-1,3,5-triazine-2(1H)-thione],

(34) 3,3'-polyoxyethylenebis[1-(1,2,3,6-tetrahydro-1,3,5-triazine-4(1H)-thioxo)propane],

(35) 2,2'-polyoxyethylenebis[1-(1,2,3,6-tetrahydro-1,3,5-triazine-4(1H)-thioxo)ethane],

(36) 2,2'-polyoxymethylenebis[1-(1,2,3,6-tetrahydro-1,3,5-triazine-4(1H)-thioxo)ethane],

(37) 3,3'-polyoxyethylenebis[1-(3,5-dimethyl-1,2,3,6-tetrahydro-1,3,5-triazine-4(1H)-thioxo)propane],

(38) 2,2'-polyoxyethylenebis[1-(3,5-dimethyl-1,2,3,6-tetrahydro-1,3,5-triazine-4(1H)-thioxo)ethane], Polymeric substances among them preferably have a number average molecular weight of no more than 10,000. The above compounds are merely illustrative, and do not in any way limit the tetrahydro-1,3,5-triazine-2-thione derivatives used in this invention.

The tetrahydro-1,3,5-triazine-2-thione derivatives can be synthesized, for example, by the method described in Journal of the American Chemical Society, 69, 2136 (1947).

Examples of the polyalkylene oxide derivatives used in this invention are condensation products of alkylene oxides such as ethylene oxide or propylene oxide with water, aliphatic alcohols, aromatic alcohols, glycols, fatty acids, organic amines and sugars; and compounds obtained by reacting these condensation products with organic acids. The polyalkylene oxide derivatives used in this invention have a number average molecular weight of usually 500 to 15,000, preferably 1,000 to 8,000.

The amounts of the tetraydro-1,3,5-triazine-2-thione derivative and the polyalkylene oxide derivative used in the lith-type silver halide photographic material of the invention vary depending upon various factors such as their structures, the molecular weight of the polyalkylene oxide, and the halide ratio of the silver halide emulsion. Preferably, the photographic material of the invention contains 1 mg to 0.1 g of the tetrahydro-1,3,5-triazine-2-thione derivative and 10 mg to 1.0 g of the polyalkylene oxide derivative per mole of silver halide.

The tetrahydro-1,3,5-triazine-2-thione derivative and the polyalkylene oxide derivative may be included together in a silver halide photographic emulsion layer or in adjacent layers such as a filter layer, an antihalation layer, a protective layer or an undercoat layer, or separately in the emulsion layer and the adjacent layers. The best results can be obtained when the two derivatives are included in the same layer, particularly in the same emulsion layer. Preferably, the two derivatives are included in the silver halide emulsion as a solution in a solvent such as water, methanol or acetone. Preferably, the two derivatives are added after the emulsion is chemically sensitized.

In the lith-type photographic material of this invention, silver chloride, silver chlorobromide, or silver chloroiodobromide may be used as the silver halide emulsion. Preferably, the silver halide emulsions contain at least 50 mole% of silver chloride.

Such emulsions may be chemically sensitized with gold, sulfur, etc., and spectrally sensitized with a sensitizing dye such as a cyanine or merocyanine dye.

The emulsion may also contain various photographic additives, for example additives for imparting high contrast such as palladium, rhodium or cobalt, stabilizers or fog restrainers such as triazole or tetrazole, hardeners such as ethyleneimine, and spreading agents such as saponin.

A glass plate or a plastic film such as a polyester or cellulose acetate film may, for example, be used as the support of the photographic material of this invention.

The lith-type silver halide photographic material of this invention may be developed with a hydroquinone-type developer containing a very small amount of a free sulfite ion, which is known in the art as the "lith developer". The lith developer is generally composed of at least one dihydroxybenzene-type developing agent such as hydroquinone, halogen-substituted hydroquinones or alkyl-substituted hydroquinones, a very small amount of a free sulfite ion, a sulfite ion buffer (such as aldehyde/alkali hydrogen sulfite adducts or ketone/alkali hydrogen sulfite adducts), an alkali carbonate, an alkali borate and an organic amine. As required, the lith developer may further contain a fog restrainer such as 1-phenyl-5-mercaptotetrazole, an antioxidation agent such as hydrazines, hydroxylamines or phenols, a dot adjuvant such as polyethylene oxides, and a buffer such as boric acid.

The lith-type silver halide photographic material containing the tetrahydro-1,3,5-triazine-2-thione derivative and the polyalkylene oxide derivative exhibits a short optimum development time and has high sensitivity, high contrast and good dot quality when it is processed in such a lith developer.

The following examples illustrate the present invention in more detail. It should be understood however that within the scope and spirit of this invention as described and claimed herein, the invention is not limited to these examples.

EXAMPLES 1-15 AND CONTROL

1. Preparation of lith-type silver halide photographic materials:

In each run, a photographic emulsion composed of gelatin and silver chlorobromide (70 mole% silver chloride) was chemically sensitized with chloroauric acid and with sodium thiosulfate, and thereafter spectrally sensitized with a cyanine dye. To the emulsion was added general photographic additives such as a hardener, a coating aid, a plasticizer and a stabilizer, and 0.36 g/mole Ag of polyoxyethylene nonyl phenyl ether containing 50 ethylene oxide units on the average (the amount "0.36 g/mole Ag" means that the amount of the polyoxyethylene nonyl phenyl ether per mole of silver halide in the emulsion is 0.36 g). Thereafter, each of the tetrahydro-1,3,5-triazine-2-thione derivatives shown in Table 1 was added in the amounts indicated.

The resulting emulsion was coated in a customary manner on a polyethylene terephthalate film base and dried to prepare a lith-type silver halide photographic material.

TABLE 1

| Example | Tetrahydro-1,3,5-triazine-2-thione derivative (compound No.) (*1) | Amount added (mg/mole Ag) (*2) |
|---|---|---|
| 1 | (1) | 5.0 |
| 2 | (5) | 5.0 |
| 3 | (7) | 7.5 |
| 4 | (9) | 5.0 |
| 5 | (10) | 5.0 |
| 6 | (11) | 5.0 |
| 7 | (16) | 10.0 |
| 8 | (18) | 12.5 |
| 9 | (23) | 15.0 |
| 10 | (25) | 17.5 |
| 11 | (28) | 12.0 |
| 12 | (32) | 18.0 |

TABLE 1-continued

| Example | Tetrahydro-1,3,5-triazine-2-thione derivative (compound No.) (*1) | Amount added (mg/mole Ag) (*2) |
|---|---|---|
| 13 | (34) (MW = 714) (*3) | 35.0 |
| 14 | (35) (MW = 700) | 35.0 |
| 15 | (36) (MW = 2300) | 115.0 |
| Control | Not added | 0 |

2. Measurement of relative sensitivity, contrast and dot quality:

Each of the photographic materials prepared in section 1 above was exposed for 3 seconds to light from a 500 W tungsten-filament lamp (100 V) through a stepped wedge with a step difference of 0.15, and then developed with a lith developer containing hydroquinone and formaldehyde/sodium hydrogen sulfite adduct at 20° C. for 2.5 minutes or 3.5 minutes. Subsequently, the developed material was subjected to stopping, fixation, washing and drying.

A photographic characteristic curve of the resulting sample was drawn, and the "relative sensitivty" value was determined on the basis of the amount of exposure required to obtain a density of 1.0 above the base and fog densities.

The average gradient of the linear portion of the photographic characteristic curve was calculated, and defined as "contrast".

The photographic material prepared in section 1 was brought into contact with a screen (gray, 133 lines/inch) and exposed for 3 seconds to light from a 500 W tungsten-filament lamp (100 V), developed under the same conditions as above, and subsequently subjected to stopping, fixation, washing and drying. The dots of the resulting sample were visually observed, and the dot quality was rated on a scale of six grades from A (excellent) to F (poor).

The results are summarized in Table 2.

TABLE 2

| | Relative sensitivity | | Contrast | | Dot quality (*) | |
|---|---|---|---|---|---|---|
| | Development time (minutes) | | | | | |
| Example | 2.5 | 3.5 | 2.5 | 3.5 | 2.5 | 3.5 |
| 1 | 30 | 72 | >12 | >12 | C | A |
| 2 | 24 | 40 | 11 | >12 | D | A |
| 3 | 44 | 83 | 10 | >12 | C | B |
| 4 | 42 | 72 | >12 | >12 | C | B |
| 5 | 23 | 57 | >12 | >12 | C | B |
| 6 | 39 | 78 | >12 | 10 | B | A |
| 7 | 43 | 81 | 10 | >12 | D | B |
| 8 | 44 | 83 | 11 | >12 | B | B |
| 9 | 38 | 77 | 9 | 11 | D | B |
| 10 | 37 | 76 | >12 | >12 | D | B |
| 11 | 42 | 83 | 10 | >12 | D | B |
| 12 | 47 | 98 | >12 | 11 | B | B |
| 13 | 41 | 79 | >12 | >12 | B | C |
| 14 | 40 | 76 | >12 | >12 | B | C |
| 15 | 32 | 68 | 10 | >12 | C | B |
| Control | 18 | 38 | 7 | 11 | F | E |

(*) The dot quality below E is generally not acceptable.

What is claimed is:

1. A lith-type lithographic silver halide photographic material of high chloride content comprising a silver halide photographic emulsion layer and a tetrahydro-1,3,5-triazine-2-thione derivative as a development accelerator and a polyalkylene oxide derivative, wherein the tetrahydro-1,3,5-triazine-2-thione derivative is a compound selected from the group of compounds represented by the formulae

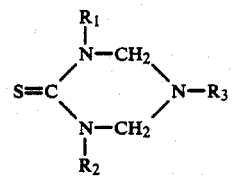

(1)

and

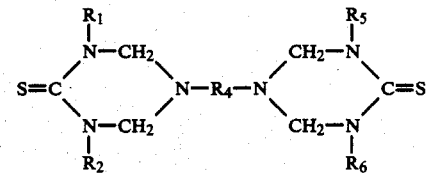

(2)

wherein $R_1$, $R_2$, $R_5$ and $R_6$ independently represent a hydrogen, an alkyl group or an aryl group, $R_3$ represents a substituted or unsubstituted monovalent organic group and $R_4$ represents a substituted or unsubstituted divalent organic group, and wherein the polyalkylene oxide is selected from the group consisting of (1) condensation products of alkylene oxides with water, aliphatic alcohols, aromatic alcohols, glycols, fatty acids, organic amines or sugars, and (2) compounds obtained by reacting the condensation products of (1) with organic acids wherein the emulsion contains at least 50 mole percent of silver chloride.

2. A lith-type lithographic silver halide photographic material according to claim 1 wherein the polyalkylene oxide has a number average molecular weight of 500 to 15,000.

3. A lith-type lithographic silver halide photographic material according to claim 1 containing 1 mg to 0.1 g of the tetrahydro-1,3,5-triazine-2-thione and 10 mg to 1.0 g of the polyalkylene oxide per mole of silver halide.

4. A lith-type lithographic silver halide photographic material according to claim 1 wherein the tetrahydro-1,3,5-triazine-2-thione and the polyalkylene oxide are combined together in said silver halide photographic emulsion layer.

5. A lith-type lithographic silver halide photographic material according to claim 1 wherein the tetrahydro-1,3,5-triazine-2-thione derivative is selected from the group consisting of compounds 5-methyl-1,4,5,6-tetrahydro-1,3,5-triazine-2(1H)-thione, 5-(2-hydroxyethyl-1,4,5,6-tetrahydro-1,3,5-triazine-2(1H)-thione, 5-(3-hydroxypropyl)-1,4,5,6-tetrahydro-1,3,5-triazine-2(1H)-thione, 5-(2-hydroxybutyl)-1,4,5,6-tetrahydro-1,3,5-triazine-2(1H)-thione, 5-[4-(2-hydroxyethyl)phenyl]-1,4,5,6-tetrahydro-1,3,5-triazine-2(1H)-thione, 5,5'-trimethylenebis[1,4,5,6-tetrahydro-1,3,5-triazine-2(1H)-thione], 3,3'-polyoxyethylenebis[1-(1,2,3,6-tetrahydro-1,3,5-triazine-4(1H)-thioxo)propane], 2,2'-polyoxyethylenebis[1-(1,2,3,6-tetrahydro-1,3,5-triazine-4(1H)-thioxo)ethane], 2,2'-polyoxymethylenebis[1-(1,2,3,6-tetrahydro-1,3,5-triazine-4(1H)-thioxo)ethane].

6. A lith-type lithographic silver halide photographic material according to claim 1 wherein the tetrahydro-1,3,5-triazine-2-thione derivative is a compound represented by the formula (1).

7. A lith-type lithographic silver halide photographic material according to claim 1 wherein the tetrahydro-1,3,5-triazine-2-thione derivative is a compound of the formula (2).

* * * * *

UNITED STATES PATENT AND TRADEMARK OFFICE

CERTIFICATE OF CORRECTION

PATENT NO. : 4,724,196

DATED : February 9, 1988

INVENTOR(S) : Tadao Shoji et al.

It is certified that error appears in the above-identified patent and that said Letters Patent is hereby corrected as shown below:

In claim 5, line 5, "5-(2-hydroxyethyl-" should be --5-(2-hydroxyethyl)- --.

Signed and Sealed this

Twenty-sixth Day of July, 1988

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,724,196

DATED : February 9, 1988

INVENTOR(S) : TADAO SHOJI, ET AL.

It is certified that error appears in the above-identified patent and that said Letters Patent is hereby corrected as shown below:

IN THE CLAIMS

Claims 2, 3, 4, 5, 6 and 7, line 1 of each, "lith-type" should be deleted.

On the face of the patent the Assignees were omitted and should appear as follows:

--DAINIPPON INK AND CHEMICALS, INC., Tokyo, Japan; and KAWAMURA INSTITUTE OF CHEMICAL RESEARCH, Saitama-ken, Japan.--.

Signed and Sealed this

Seventh Day of February, 1989

*Attest:*

*Attesting Officer*

DONALD J. QUIGG

*Commissioner of Patents and Trademarks*